US005934672A

United States Patent [19]

Sines et al.

[11] Patent Number: 5,934,672

[45] Date of Patent: Aug. 10, 1999

[54] SLOT MACHINE AND METHODS OF OPERATION

[75] Inventors: Randy D. Sines, Spokane, Wash.; Steven L. Forte, Henderson, Nev.

[73] Assignee: Digideal Corporation, Spokane, Wash.

[21] Appl. No.: 08/603,417

[22] Filed: Feb. 20, 1996

[51] Int. Cl.[6] ..... A63F 5/04

[52] U.S. Cl. ..... 273/143 R; 273/138 A; 463/1; 463/20

[58] Field of Search ..... 463/16, 20, 21, 463/30, 31, 32; 273/143 R, 138.1, 138.2, 138 A, 138 R

[56] References Cited

U.S. PATENT DOCUMENTS

| | | | |
|---|---|---|---|
| 3,759,525 | 9/1973 | Davis | 273/143 R |
| 4,095,795 | 6/1978 | Saxton et al. | 463/20 |
| 5,018,737 | 5/1991 | Okada | 273/143 R |
| 5,074,559 | 12/1991 | Okada | 273/143 R |
| 5,342,047 | 8/1994 | Heidel et al. | 463/29 |
| 5,393,057 | 2/1995 | Marnell, III | 463/13 |
| 5,423,540 | 6/1995 | Taxon | 273/143 R |
| 5,423,541 | 6/1995 | Nicastro et al. | 463/20 |
| 5,429,507 | 7/1995 | Kaplan | 434/112 |
| 5,449,173 | 9/1995 | Thomas et al. | 273/143 R |
| 5,456,465 | 10/1995 | Durham | 463/21 |
| 5,472,197 | 12/1995 | Gwiasda et al. | 273/143 R |
| 5,580,055 | 12/1996 | Hagiwara | 273/143 R |

FOREIGN PATENT DOCUMENTS

| | | | |
|---|---|---|---|
| 5-285252 | 11/1993 | Japan | 273/142 HA |
| 6-63217 | 3/1994 | Japan | 273/138 A |
| 6-254208 | 9/1994 | Japan . | |
| 2 145 266 | 3/1985 | United Kingdom | 273/143 R |
| 2 225 889 | 6/1990 | United Kingdom | 273/143 R |
| 2 233 806 | 1/1991 | United Kingdom . | |

*Primary Examiner*—Jessica J. Harrison
*Assistant Examiner*—Sheila Clayton
*Attorney, Agent, or Firm*—Wells, St. John, Roberts, Gregory & Matkin, P.S.

[57] ABSTRACT

A slot machine is modified to identify subsets of related symbols in a randomly selected set of symbols. The symbols within the subset can then be directed to wheels or other movable visual displays in an order such that related symbols will appear first to a player. A deciding symbol will be indexed on the last wheel to reach a stationary position. Slowing of the speed at which symbols are displayed to a player on the final wheel to be indexed further adds to the anticipation and suspense of playing the enhanced games. Additional enhancement of play on the slot machine can be achieved by optically extending the viewed area of one or more rotating wheels.

25 Claims, 7 Drawing Sheets

SLOT MACHINE AND METHODS OF OPERATION

TECHNICAL FIELD

The field of this invention is slot machines and methods for enhancing their operation.

BACKGROUND OF THE INVENTION

The gaming industry has in recent years undergone a significant expansion. Many different types of card games, keno, lotteries, roulette, and other forms of gaming have drawn attention during this expansion. Substantial efforts have been made to add variety to such games to enhance the attractiveness of the games for the players. Despite this increased variety, the most popular form of gaming continues to be centered about slot machines. They account for approximately three-fourths of the total volume of all gambling activities in the United States and their popularity seems to be increasing.

Because of the volume of slot machine gaming, numerous devices, rules and methods of have been proposed and introduced in efforts to improve the games. Video slot machines have been introduced and were initially well received, but have not replaced the mechanical displays associated with the "one arm bandits." Push button operation has also come and passed through popularity. Despite many such noticeable improvements or changes, many people still prefer the more traditional mechanical slot machines. The action and sounds of mechanical reel slot machines have a particular and very widespread appeal to a large number of gamblers seeking this form of entertainment.

Despite numerous improvements made over the years since 1892, when machines that paid off in coins were introduced, there remains a need for improved slot machines and methods which provide more attractive slot machine play and associated entertainment.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
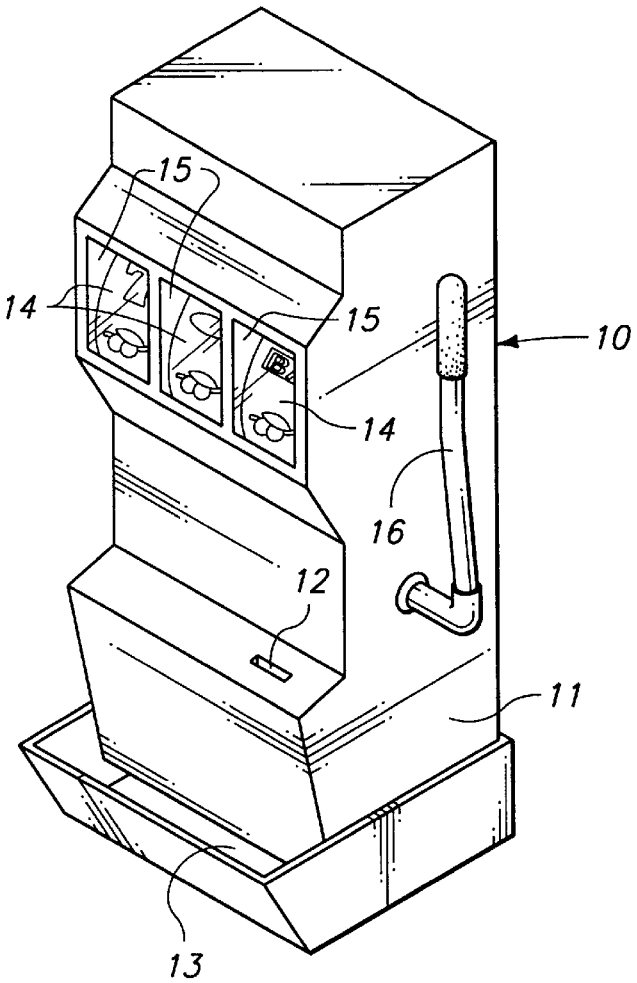
FIG. 1 is a simplified perspective view of a typical slot machine.

A conventional slot machine 10 is generally illustrated in FIG. 1. A housing 11 encloses its mechanical and/or electronic components. A coin slot 12 is provided to receive one or more coins as the machine is being activated by a player. Coins paid out as a result of machine operation are discharged by the slot machine 10 into a trough 13.

Most slot machines include a plurality of upright cylindrical reels 14 having visual symbols arranged in a series about a transverse rotational axis. A randomly determined set of symbols are displayed to a player at the completion of each operational sequence initiated by the player. The individual reels are angularly indexable to stop the reels and present a stationary set of symbols which are positioned at selected angular positions about their respective relational axes. The indexed reels are presented for viewing purposes through transparent windows 15.

Each operational sequence of slot machine 10 is started by pulling upon a handle 16 or otherwise activating play of the machine. Button activation controls can also be used in such machines, but the action of physically pulling a handle 16, the sounds of the reels 14 as they are indexed and fall into line, and the expected jangle of cascading coins dropping into the trough 13 all form part of the mystique or attraction attributed to slot machines in general.

In most modern slot machines, the reels 14 are indexed or stopped at randomly selected angular positions under control of electronic circuits and microprocessors. The microprocessors often function as random number generators which randomly select a set of symbols to be assigned to the reels as they are indexed or stopped. The microprocessors also determine the amount of each payout, if any, according to preset combinations of the visual symbols displayed on the reels. Although the random selection of these symbols forms no part of the present invention, an exemplary description of the implementation of this feature can be found in U.S. Pat. No. 4,095,795, hereby incorporated by reference.

Figure 2:
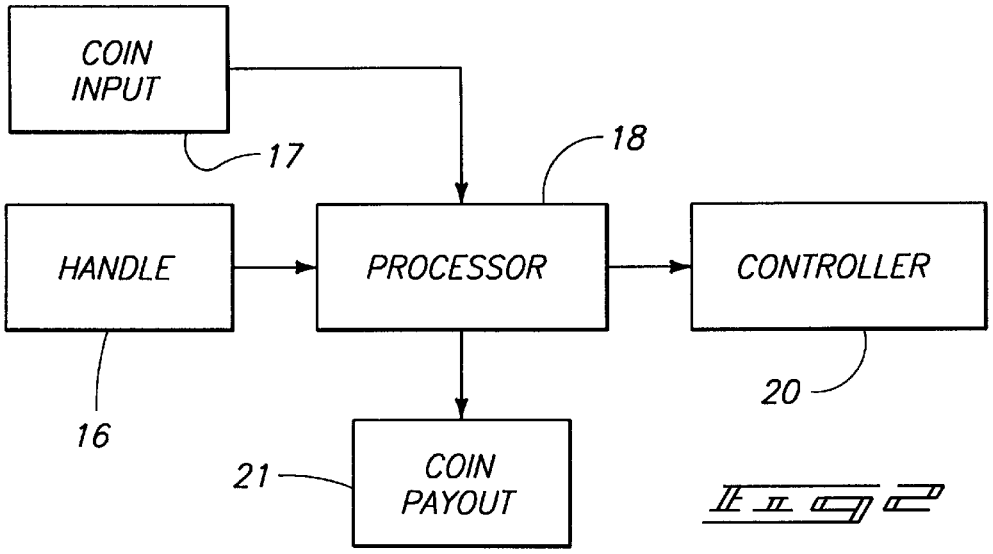
FIG. 2 is a schematic diagram of a control system.

A generalized diagram of the control features for a modern slot machine is provided in FIG. 2.

A conventional coin input 17 is provided to send a signal to processor 18 when one or more coins have been inserted through coin slot 12. Upon closing a player-operated switch by use of handle 16 or a button, the processor 18 randomly selects a set of symbols to be assigned to the machine reels 14. The processor also calls for the reels 14 to be spun or otherwise initiates visual operation of the slot machine 10, such as by controlling a suitable display to effect the visual equivalent of or an alternative visual prelude functioning similar to mechanical spinning of the reels.

Processor 18 then angularly indexes reels 14 as their rotation is stopped to display the randomly selected set of symbols. This is achieved through operation of a conventional electromechanical controller 20. While initiation of the rotation of the individual reels 14 takes place simultaneously, they are normally indexed in a timed sequence which typically proceeds from one side of the machine to its remaining side. If the selected set of symbols on the indexed reels 14 results in a monetary payout, processor 18 sends a signal to a coin payout mechanism 21, which then dispenses the coins to trough 13 or increments a credit display (not shown).

As used herein, the term "visually movable display" shall include any form of display incorporated within a slot machine for presenting a series of symbols that can be positionally indexed as a display for selected set of symbols to a player at the completion of an operational game sequence that has been initiated by the player. A visually movable display can be either a physical symbol-bearing member, such as a wheel, cylinder or disk, or can be any form of symbol readout or display device which can be cycled through a sequence of different symbols by electronic means. This definition specifically includes both rotatable reels having symbols displayed about their circumferential peripheries, and rotatable disks or annular wheels or reels having symbols on display faces transverse to their axes. "Symbols" can be alpha-numeric, graphic or blank.

Additional forms of displays contemplated for use in some forms of this invention further include liquid crystal displays, flat panel semiconductor display screens, polarized screen displays, or more preferably stereoscopic optical projection displays utilizing a holographic screen which can simulate a three-dimensional image for viewing by the slot machine user. Although such electronically controlled displays are contemplated, it should still further be appreciated that many slot machine players still prefer the action of more traditional mechanical wheels or other reels, and that at this time the invention is considered most applicable to mechanical reel slot machines and such are the most preferred version of carrying out at least some of the forms and methods of this invention.

This disclosure is applicable to any conventional form of controller 20. Examples currently in use include individual stepper motors for the symbol-bearing wheels or various combinations of motor and brake assemblies. The physical control of such rotating wheels are well known with respect to slot machine design. Further description of controller 20 is believed to be unnecessary in order to enable one familiar with such equipment to utilize the present improvements in slot machine features and operation.

One novel aspect of this invention relates to having reordered stop sequencing of the symbols of a selected set. Reordered stop sequencing can be effected by using variable stop sequences, or by remapping a particular symbol set to effect a reordered stop sequence for the symbols. The reordering of the symbol stop sequences by using variable reel stop sequencing is effected by having different stop sequence assignments which cause the reels 14 or simulated reels (not shown) to stop in different orders depending upon the set of selected symbols which are to be displayed to a player. For example, in typical three-reel slot machines the reels are sequentially indexed to stop the left-hand reel first, the middle reel next, and the right-hand reel last. One of the novel concepts of this invention is to vary the indexing operation for the multiple reels so as to effect reordering of the stopping sequence. This reordering is done as a variable dependent upon the specific set of symbols which are to be displayed. This symbol-position-variable or reel-variable stop sequencing allows greater anticipation to be developed because a symbol set combination which includes two or more matching symbols can be indexed to produce a stopping sequence which first stops the similar symbols. This creates greater expectation on the part of the slot machine player that a winning combination of symbols may occur. The reordering may also consider other relationships than just true matching, such as explained below with regard to symbols which are considered related.

The reel-variable stop sequencing can advantageously involve an index strategy accomplished by programming the reels 14 or other visually movable displays so that the indexed order in which each symbol of a selected set is displayed to a player becomes a function of which order of presentation results in the most suspense or anticipation. In the preferred embodiment, indexing of the displayed symbols is sequenced so that the "deciding" symbol is the last to index and therefor be viewable by the player. Matching or otherwise related symbols contained in the set of symbols to be indexed are preferably indexed first, although with machines having more than three reels, the matching might conceivably be done with internal reels which otherwise might form part of a paying symbol combination. Alternatively, the first symbol indexed may even more preferably be a wild card symbol. Thus the reel which has been assigned this wild card symbol could in one form of the invention be stopped, thus providing by definition two related symbols in the first and second reels being indexed.

As a further explanation, assume that a group of three identical symbols are required for a specific payout when playing the slot machine. If the randomly selected set of symbols includes two identical symbols and one of a different nature, as soon as a player sees a mismatch or otherwise unwanted symbol, the players expectation and suspense for winning associated with operation of the slot machine is over until the next pull. This is true even though the symbols within the set of symbols might not yet all be displayed.

A further alternative method for reordering the apparent stopping sequence of the symbol set is by remapping the symbols from one specific order combination to another slightly different symbol set combination which contains the same symbols but in a different order. The same significance with regard to winning applies in either the original set in its first order, or to the reordered set of the same symbols which are assigned into a second order. Use of this technique can allow the slot machine to be stopped using the same reel stopping sequence, such as the left-to-right stopping sequence now employed.

It should still further be appreciated that the stop-sequence reordering concept of this invention may have still another alternative form in which the reel stopping sequence reordering and the remapping of symbols to alternative reels may be combined to effect some further operational flexibility and advantage. For example, it may be possible to have the player decide whether he or she wants to have the reels stop in different reel-varying sequences to enhance the interest in play. Other players may choose to have the more traditional stopping sequence for the reels because they find the variations distracting or too disordered. Still further it may be possible to have a slot machine programmed to function in one mode part of the time and in the other mode or other modes other parts of the time.

To increase suspense and anticipation on the part of the player, the present improvement requires the software for processor 18 to either: a) rearrange the order of assigning symbols to the individual reels 14 so that the odd symbol or symbols (or the winning symbol or symbols) is or are directed to the last reel or reels to index or stop, or b) cause the software to rearrange or remap the order in which the reels 14 are indexed or stopped to achieve the same desired result. The resulting change in sequence of play will result in a player becoming more emotionally involved in the game, thus making it more exciting.

Reordering the indexing sequence for the individual reels 14 each time the game is played also eliminates expectations of certain results each time that the machine is indexed from one side to the other or in any other pattern, since the order of indexing will be random and cannot be associated with predetermined results.

In its basic form, the present method of operating a slot machine first requires that processor 18 must be programmed to randomly select a set of symbols to be assigned to the visually moving displays, exemplified by the three reels 14 shown in FIG. 1. Processor 18 must then determine whether the selected set of symbols includes a subset of related symbols numbering one less than the number of visually movable displays or reels 14.

"Related" symbols can include any two or more symbols that form part of an identified combination of symbols associated with identified slot machine payouts. This typically includes identical symbols and symbols arranged in a defined sequence. Where a winning symbol set includes all identical symbols, there will be several such sets of related symbols within the complete set of different combinations forming the available symbol sets. The selected subsets can include any group of the selected symbols within the set, so long as it includes a subset of related symbols that is one less in number than the winning set.

Finally, controller 20 must assign the symbols of the selected set to individual visually movable displays or reels 14. In the basic presentation of this improvement, processor 18 is programmed to assign the symbols within a subset of related symbols to all of the visually movable displays or reels 14 but the last reel 14 to be indexed at the completion of an operational sequence of the slot machine. The method is completed by the processor 18 then assigning the remaining symbol of the selected set to the last visually movable display or reel 14. As discussed previously, this symbol might be related to the others in the subset to form a winning set of symbols, or it might be unrelated and result in no payout.

Another improvement feature of this invention relates to varying the speed at which the last symbol or symbols are indexed. One important purpose is to add increased anticipation and suspense for the player concerning the outcome of each slot machine operational sequence or play. In a preferred embodiment of slot machine operation, this feature is combined with a novel reordering strategy such as previously described, thereby enhancing the anticipation attached to indexing of the last visually movable display or reel to which the final symbol contained within a set of symbols has been addressed.

In addition to assigning to the initially visible movable displays a subset of related symbols that signify a possibility of a game payout, one can further enhance the suspense of game operation by slowing the final speed of the last visually movable display in comparison to the final speeds of the initially visible displays. For example, the last reel is slowed at a more gradual deceleration rate during the period between indexing of other reels and the time the final reel is stopped and fully indexed. It is preferable to not add additional time to a complete operational sequence or play of a particular slot machine. Thus the total time required to stop the last reel preferably remains the same. However, the indexing process for the final reel is accentuated.

One form of the preferred methods includes accelerated indexing of the initial display symbols, such as the first and second reels. This shortened time between pull of the slot machine lever or other activation (pushing a button), allows additional time for concentration of the player's attention onto the last reel. The quicker stopping or indexing of the initial symbols also allows the deceleration rate of the last reel to be decreased, to give the reel or other similar display an appearance which increases the player's ability to perceive the symbols which are approaching the index position. This significantly builds anticipation in the mind of the player and increases the player's involvement and enjoyment of playing the slot machines. The novel methods preferably include decelerating the angular velocity or apparent angular velocity of the last reel or display at a rate which causes increased deceleration during the period associated with indexing the initial reels or displays, and then having greater amounts of time to view the last reel by itself and at a lower angular velocity and reduced deceleration rate. For example, the first and second reels might be decelerated at a rate which is calculated to occupy only 10–33 percent of the total play period defined as the time period during which the slot machine has spinning or other display movement or play activity. The remaining 67–90 percent of the play period can be used to more gradually bring the last reel to stop.

The deceleration rates of the reels during the initial play period may be approximately 2–100 times greater than the average rate of deceleration for the final reel. The final reel and initial reels can be decelerated at the same rate initially, or at differing rates initially. In general the final reel will be decelerated at a deceleration rate which is equal to or less than the deceleration rate of the initial reels. The initial reels are those reels stopped in advance of the accentuated emphasis on the final or last reel or reels. The deceleration rates of the initial and final reels can be linear or demonstrate a deceasing rate over the play period or portion of play period during which the reel is being stopped.

It is possible to decelerate the final reel at a linearly decreasing angular velocity; however, the appearance and anticipation developed is better when the novel methods involve decreasing the angular velocity of the last reel at a relatively high rate during the first part or portion of the play period while the initial reels are being decelerated, and then changing the deceleration rate of the last reel to be less than average during the second portion of the play period during which the last reel or reels are being visibly emphasized. Thus the preferred methods include slowing the final reel at a deceleration rate in excess of the average rate of deceleration during the first portion of the play period, coupled with a deceleration rate which is less than the average rate of deceleration during the second portion of the play period. In more preferred forms of the inventive methods and apparatuses, the deceleration rate during the first portion of the play period will exceed 3 times the minimum deceleration rate of the last reel during the second portion of the play period, more preferably 5 times the minimum deceleration rate, even more preferably 6–10 times the minimum deceleration rate. It should further be understood that the deceleration rates can be continuously varied from a high rate initially to a lower rate for the final reel during the second portion of the period the reel is decelerated.

It should also be understood that it is alternatively possible in the practice of the novel methods and apparatuses to selectively or controllably invoke the emphasis on the slowed or accentuated indexing of the last reel or symbol, dependent upon whether the initial reels present a related symbol combination or not. If the randomly selected set of symbols does not produce a potential winning combination, then there is no subset of related symbols which cause the player to anticipate a win with any symbol which may assume the index position. In these modified operational methods, the slower deceleration rate of the last reel can be brought to a rate which is higher than deceleration rates which apply when the initial reels have a related combination of symbols which would create anticipation by the player. These variations in deceleration rate can be used to decrease the total playing period and increase revenues per hour of casino time.

Sound also can be added to the concepts presented herein to further emphasize the anticipation element of waiting for the identification of the final symbol within a set. Repetitive sounds can be played at varying speeds corresponding to the speed of the final display or can be played at varying volumes corresponding to the changes in speed. Additionally, a varying tonal pitches can be used to call attention to this feature. The nature of the sound itself can be modified as the final display is indexed. Various combinations of these sound enhancements can be coordinated with indexing of the display by proper programming of processor 18.

FIGS. 3–7 broadly illustrate physical forms of a slot machine incorporating another feature of the invention that facilitates viewing of an extension of that portion of a physical reel or disk normally seen by a player through a window 15. In these embodiments, a wider range of view of the oncoming symbols is provided during indexing of the wheels or reels, thereby adding to the player's ability to perceive oncoming symbols and providing increased interest and excitement for the slot machine player. This increased reel viewing ability provides visible access to preferably greater than 25 percent of the available symbols of at least one of the reels. More preferably, the reel viewing provides visual access to greater than 33% of the symbols on the reel. Even more preferably, reel viewing provides visual access to greater than 50% of the symbols on the reel.

Figure 3:
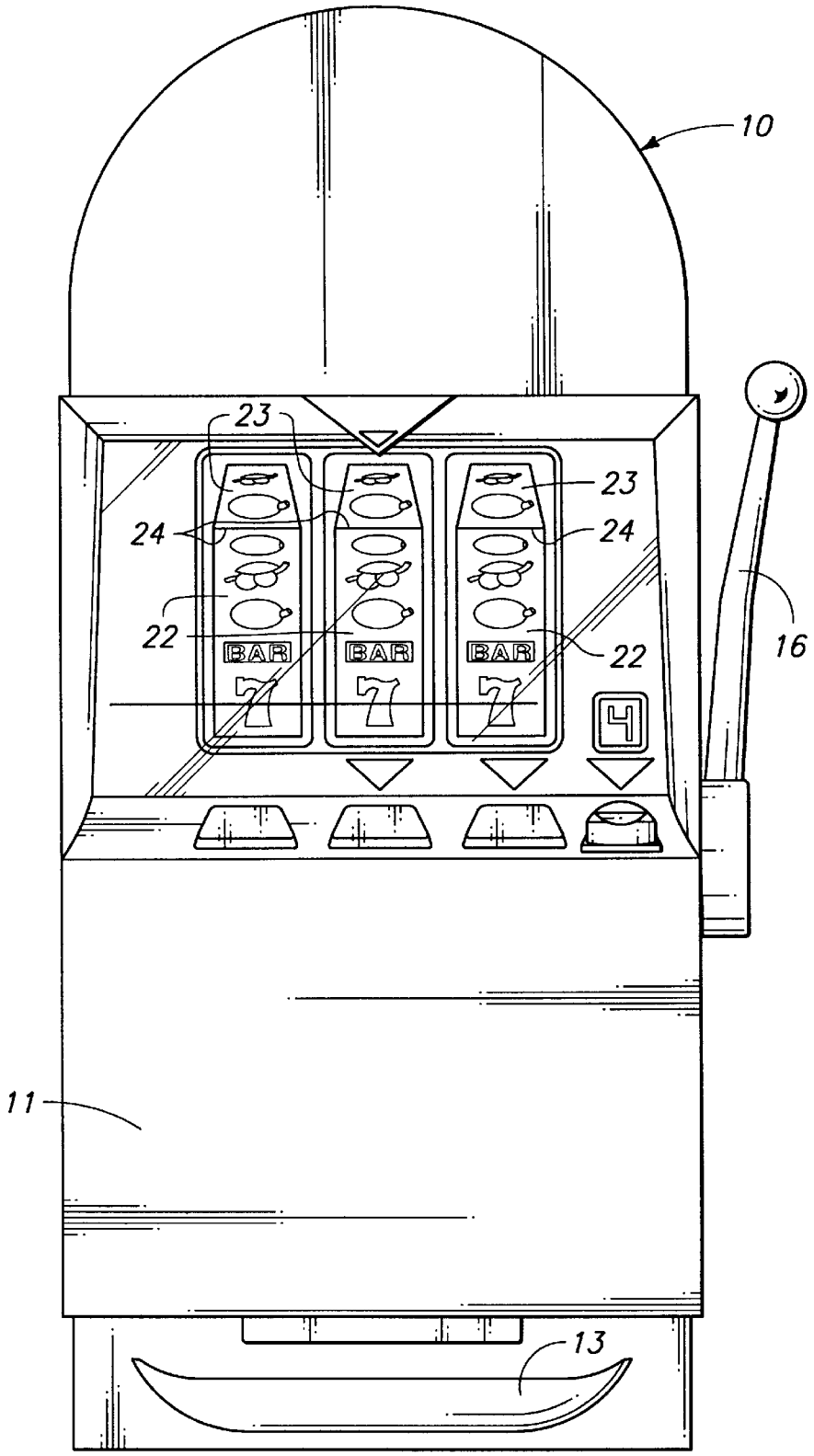
FIG. 3 is a front elevation view of a first embodiment of the invention.
Figure 4:
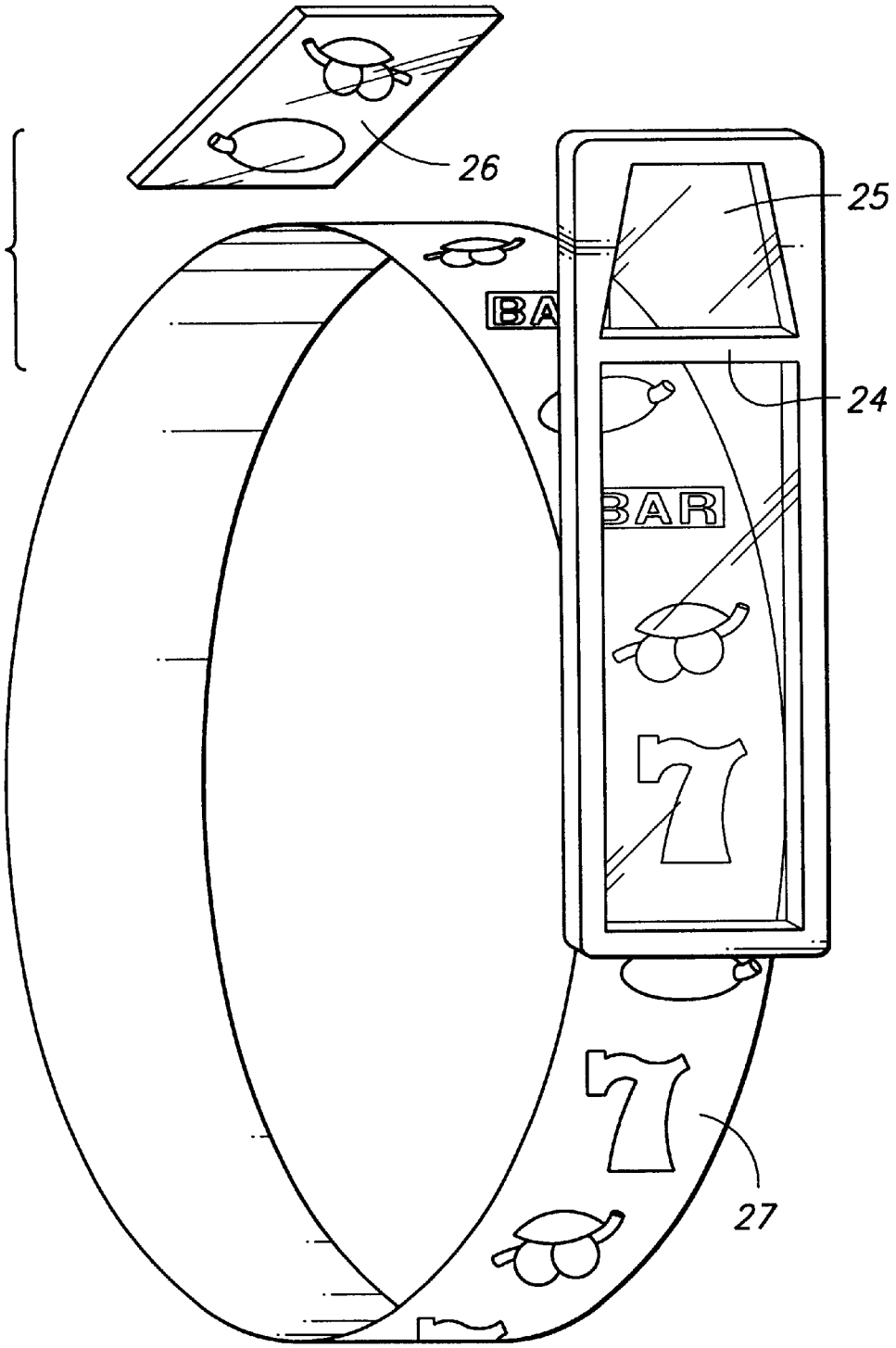
FIG. 4 is a diagrammatic view of the window improvements shown in FIG. 3.
Figure 5:
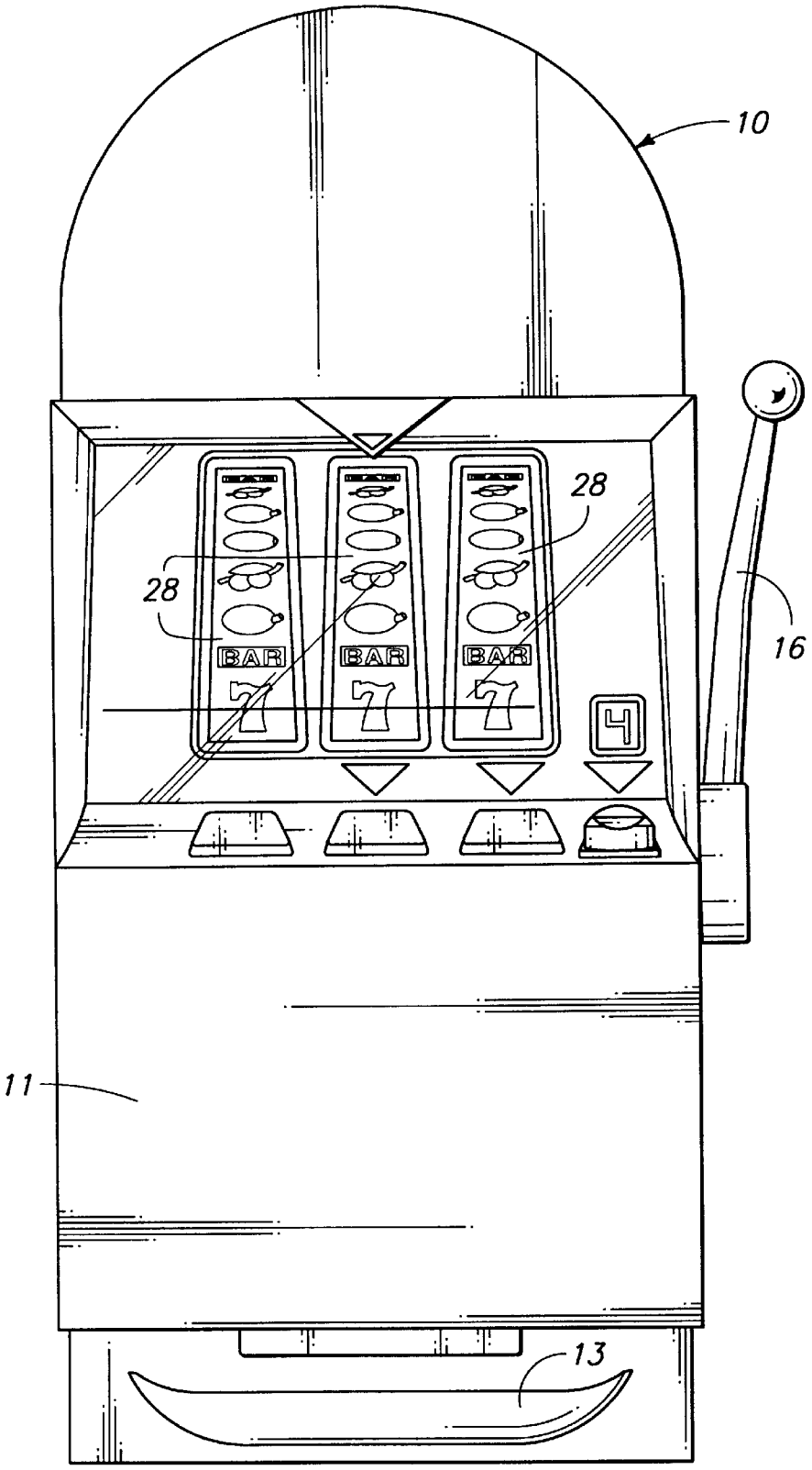
FIG. 5 is a front elevation view of a second embodiment.

With respect to FIGS. 3 and 5, the more extensive viewing area is provided on each of several reels having visual symbols arranged so as to provide a series of symbol images which approach and potentially align with an index marker. In the embodiments of FIGS. 3–5, the cylindrical reels are individually indexable to present a set of symbols at selected angular positions about their respective axes for viewing purposes.

In FIG. 3, windows 22 are provided for directly viewing a first portion of the symbols at the selected angular position on each reel. An ancillary display 23 is located immediately above each window 22, the demarcation between window 22 and ancillary display 23 being shown as line 24.

The ancillary display 23 might be any optical system for transmitting a pictorial representation of a portion of the reel periphery. One example of such an ancillary display is shown in FIG. 4. In this drawing the ancillary display comprises a reversing lens 25 and an angled mirror 26 that reflects otherwise unviewable portions of the symbol strip 27 to lens 25 for viewing purposes. The result, as depicted in FIG. 3, is an image of the reel that is substantially extended in the direction of oncoming symbols during indexing of the reels.

By providing a player with an extended view of the reel, the anticipation and ability to gauge the likelihood of a payout upon completion of reel movement is substantially heightened.

It is to be understood that a single window can be used for all three reels, perhaps with appropriate framing to identify the individual reels. Similarly, a single ancillary display can be substituted in place of the individual display elements specified in the drawings.

FIG. 5 also illustrates an extended view of the symbol strips on the individual reels of a modified slot machine. In this instance, the extended view is obtained by an optical system providing visual access to a relatively large angular portion of each reel periphery. As one example, this might be achieved by reflecting light from the reel peripheries to bundles of optical fibers leading to the planes of the individual viewing windows identified at 28. The viewable image of the symbols is preferably structured so that the symbols moving toward the index position are increasing in size.

Figure 6:
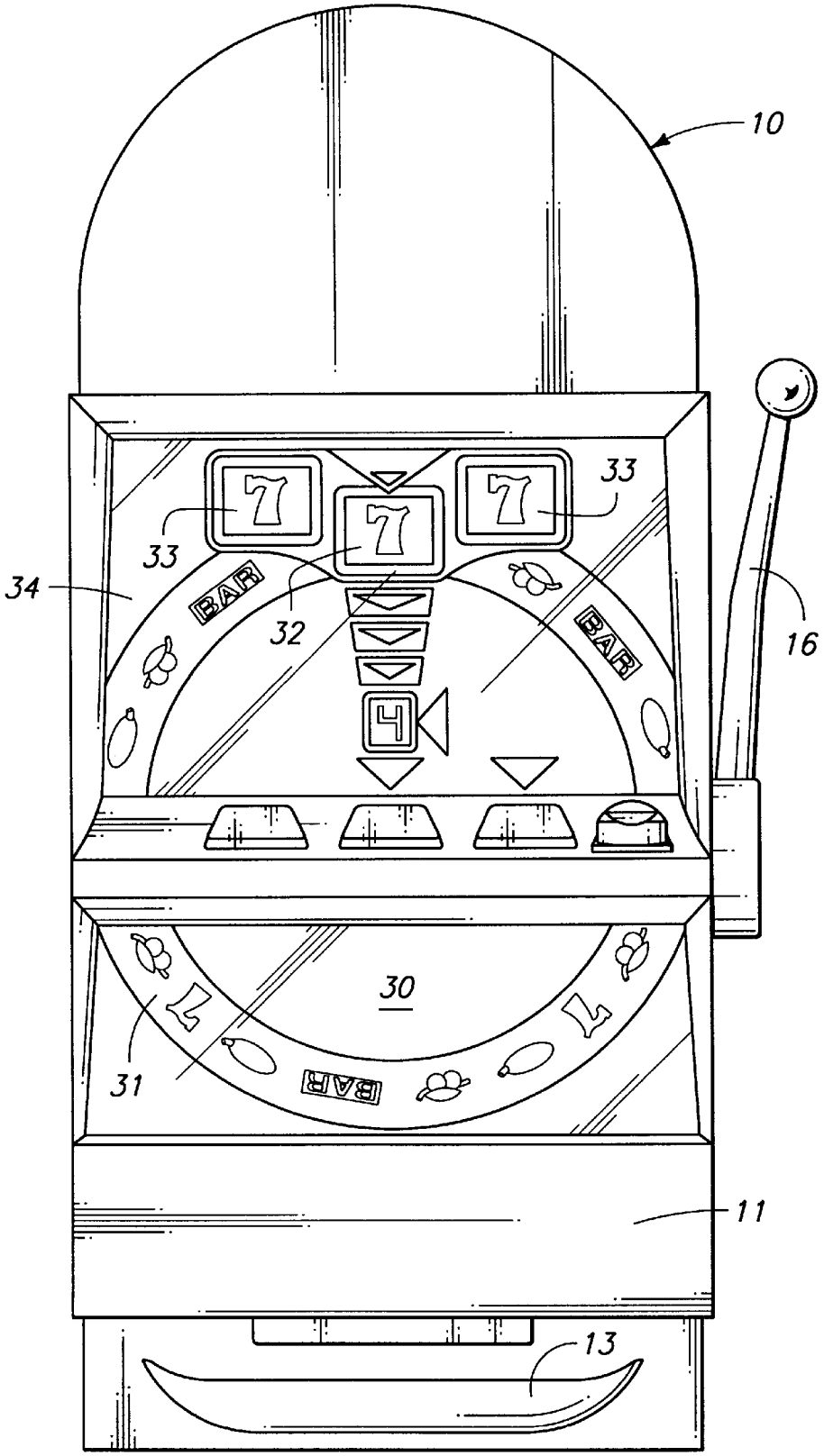
FIG. 6 is a front elevation view of a third embodiment.
Figure 7:
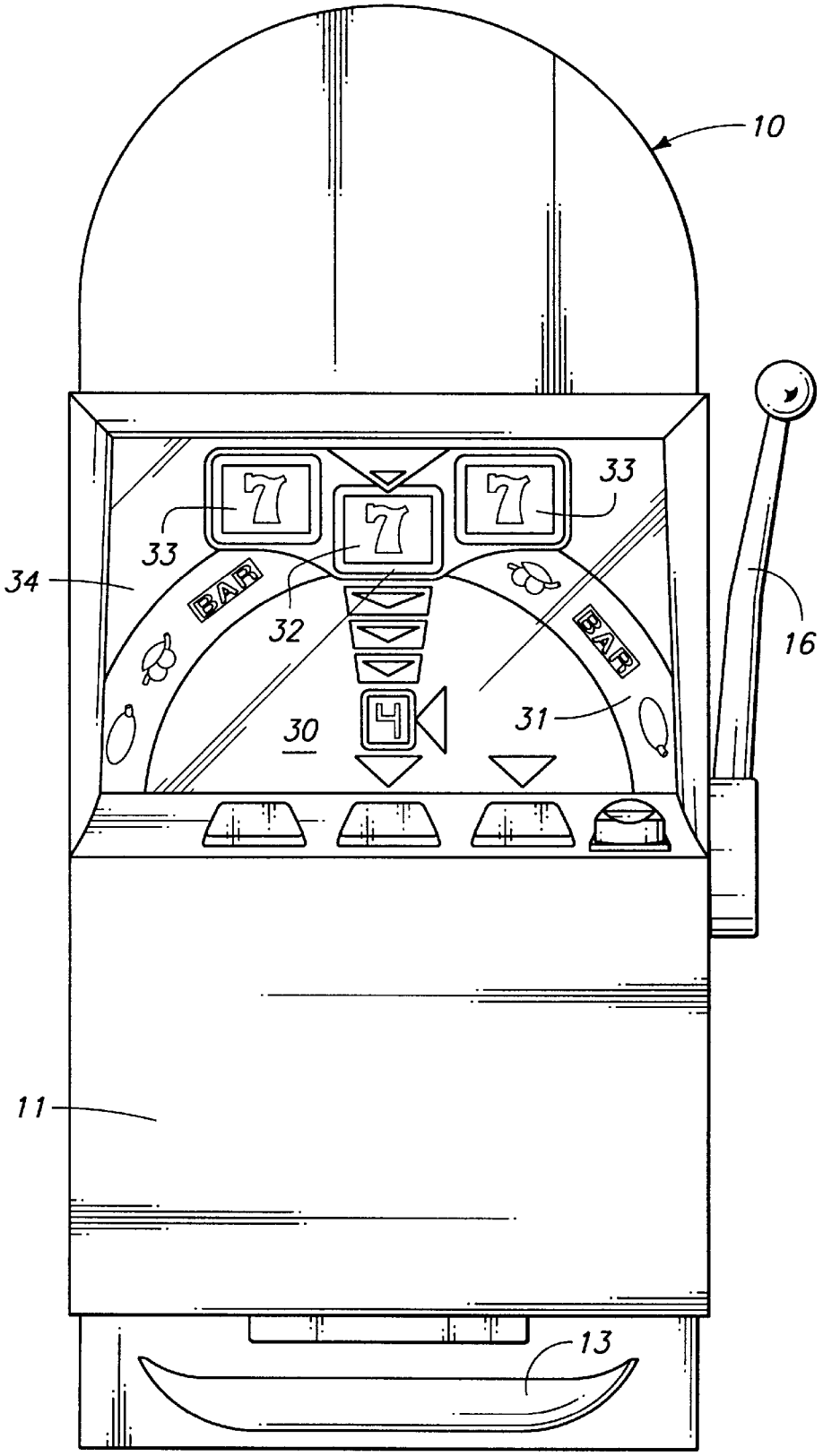
FIG. 7 is a front elevation view of a fourth embodiment.

FIGS. 6 and 7 illustrate modified forms of a slot machine in which at least one of the visually movable displays is a radial wheel 30 having symbols arranged about an annular display face 31 transverse to its axis. The indexed symbols on wheel 30 are viewed through a center window 32, flanked by side windows 33. The symbols shown in windows 33 might be optically accessed from reels or other rotatable devices (not shown).

In this form of the invention, a large window 34 is provided on the slot machine. A substantial portion of the symbols arranged about the annular display base 32 can be viewed as the wheel 30 rotates. This permits the player to view symbols adjacent to the symbol or symbols that can be seen in center window 32, thereby again increasing the anticipation of the player and holding his or her attention as the wheel 30 approaches its indexed position.

In FIG. 6, the annular display face 31 of wheel 30 is almost entirely visible. In FIG. 7, almost one-half of the annular display face 31 is visible. It is preferred that at least one-quarter of the annular display face 31 about wheel 30 be viewable through the enlarged window 34 on the slot machine.

Figure 8:
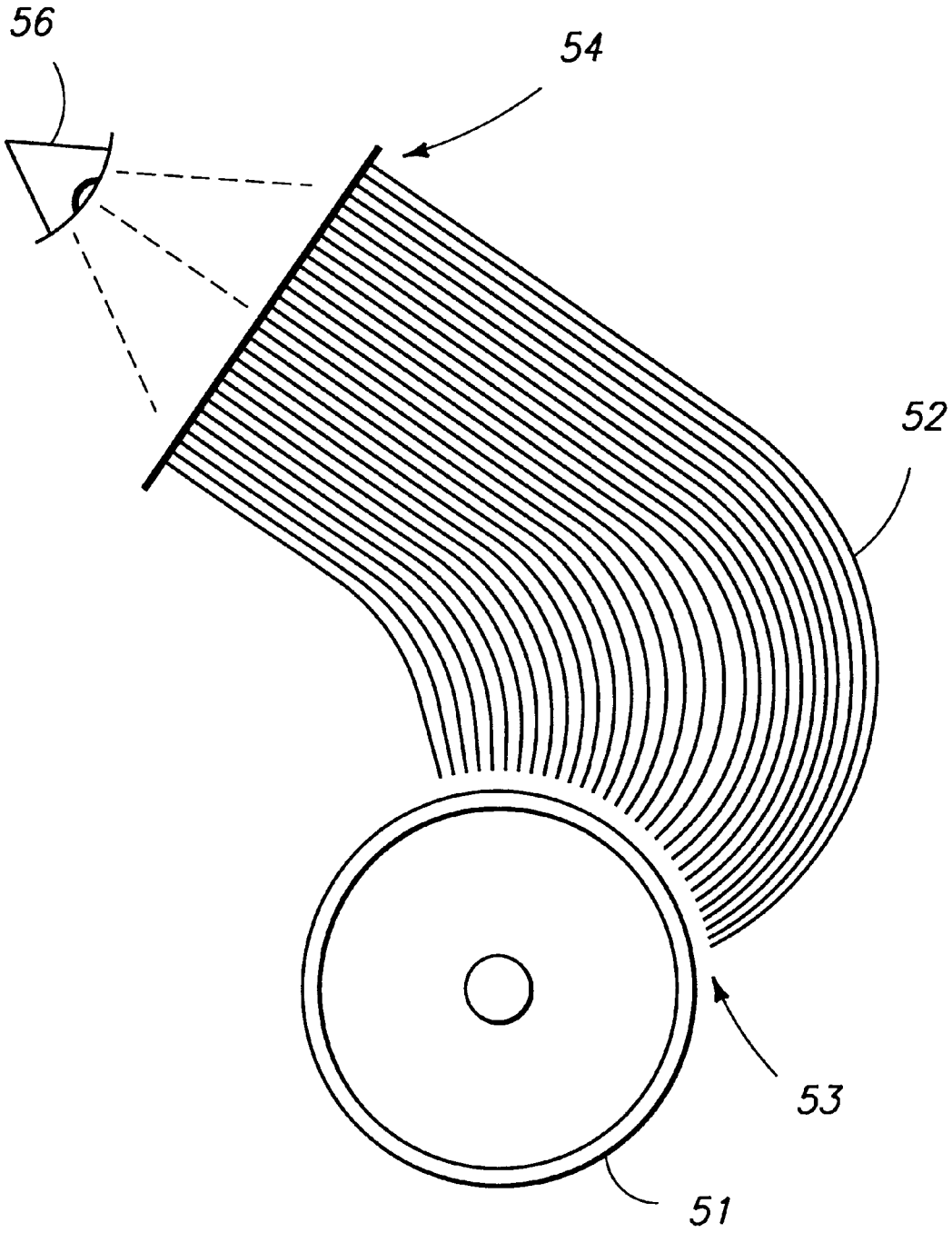
FIG. 8 is a schematic presentation of optical components which may be used in a further form of the invention.

FIG. 8 shows an alternative form of the invention in a schematic presentation. In this view a single cylindrical reel 51 is shown, but it is illustrative of any number of desired reels. Alternative reel or display configurations are also possible. A plurality of optical fibers 52 are arranged with image input ends 53 adjacent to an image source, which in this form is the symbol-bearing outer surface of reel 51. The image input ends 53 form an image collector which is shaped or otherwise configured to gather an image from the reel. The image can advantageously be a composite image made from numerous image pixels. The optical fibers form an image conveyance which transfers the image or images gathered from the reel, and conveys them to a viewable presentation. This is done at optical fiber display ends 54. The display ends 54 of the optical fibers are positioned so as to form an image emitter or image emitting array which is either directly visible or passed through one or more lenses or screens 55 in order to focus or otherwise enhance the image viewed by the player. The player sees an image, or more preferably a composite of numerous image pixels, which show the symbols present on the periphery of the reel or otherwise made available from the image source for viewing by the player's eye 56.

The optical fibers can be of various types. In one form of the invention some or all of the optical fibers can be tapered to allow the desired degree of magnification or demagnification. This can be used to reduce the viewing size of the symbol images to observer 56 dependent upon the proximity of the symbol to an index marker (not shown in FIG. 8).

It is to be understood that the various features described above can be used both individually and in combination, to lend additional excitement and interest to play on a slot machine. In most instances existing slot machines can be retrofitted to include these enhancements by modifying the viewing windows or optical elements providing visual access to the wheels presenting game symbols for indexing purposes, or by modifying the software that controls operation of a conventional processor 18.

As an example, one might remap the randomly generated symbols so that the wheel 30 in FIGS. 6 or 7 is the last of the visually movable displays to be indexed. In addition, the rotational speed of symbols on wheel 30 can be slowed in relation to the rotational speed of the symbols viewed in windows 33 as these symbols approach their indexed positions. At the same time, the display of symbols in the side windows 33 might be accelerated.

In this manner, the viewer will quickly note the possibility of a payout when related symbols appear in the side windows 33, and his or her attention will be drawn to the slower movement of symbols on the wheel 30 as it approaches its indexed position for viewing of a symbol in the center window 32. This will increase the suspense and excitement incidental to each play of the machine.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A slot machine, comprising:

a plurality of reels mounted for rotation about at least one rotational axis, symbols arranged in a series about the plurality of reels, the plurality of reels being individually indexable to present a selected set of symbols positioned at selected angular positions about their respective at least one rotational axis for viewing purposes;

at least one window for directly viewing a first portion of the symbols at the selected angular position on at least one of said plurality of reels;

at least one ancillary display adjacent to the window for viewing a second portion of the symbols on the at least one reel which are not directly viewed through the window and which approach the selected angular position as the at least one reel turns during play of the slot machine;

the at least one ancillary display including a mirror reflecting an image of the second portion of the symbols for said at least one reel; said image of the second portion of the symbols being viewed by a player through said at least one ancillary display.

2. The slot machine of claim 1, further comprising at least one lens through which said image of the second portion of the symbols is passed between said at least one reel and said at least one ancillary display.

3. The slot machine of claim 1, wherein the at least one window includes a separate window element and a separate ancillary display for each reel.

4. The slot machine of claim 1, further comprising at least one lens through which said image of the second portion of the symbols is passed between said at least one reel and said at least one ancillary display, said at least one lens being a reversing lens.

5. The slot machine of claim 1, wherein the plurality of reels comprise independently rotatable cylinders having said symbols arranged about their respective circumferential peripheries.

6. A slot machine, comprising:

a plurality of reels, each reel having symbols arranged upon the reels; the reels being capable of being individually indexed to present varying sets of selected symbols which determine play of the slot machine;

at least one display for viewing at least a portion of the symbols presented on the reels;

at least one image collector for collecting images of symbols from at least one of the reels; said image collector being capable of collecting images of at least 25 percent of the available images associated with said symbols;

at least one image conveyor for conveying the image from the at least one image collector to provide display of an image upon the at least one display for viewing by a player.

7. The slot machine of claim 6, wherein the at least one image conveyor includes an array of optical fibers.

8. The slot machine of claim 6, wherein the at least one display includes:

a window which provides for directly viewing a first portion of the symbols on each reel; and an ancillary display which provides for indirectly viewing a second portion of the symbols on the at least one of the reels.

9. The slot machine of claim 6, wherein the plurality of reels comprise independently rotatable cylinders having visual symbols arranged about their respective circumferential peripheries.

10. A slot machine, comprising:

a plurality of reels, each reel having visual symbols arranged about the circumferential periphery of the reels; the reels being capable of being individually indexed to present varying sets of selected symbols which determine play of the slot machine;

at least one display for viewing at least a portion of the visual symbols presented on the circumferential periphery of the reels; said at least one display being capable of displaying images of the at least 25 percent of the available images associated with said visual symbols about the circumferential periphery of at least one reel;

an array of optical fibers which conveys at least portions of the at least one display.

11. The slot machine of claim 10 wherein the at least one display includes:

a window which provides for directly viewing a first portion of the symbols on said at least one reel; and an ancillary display which provides for viewing a second portion of the symbols on said at least one reel, said second portion being not directly viewed through the window.

12. A slot machine, comprising:

a plurality of reels, each reel having visual symbols arranged in a series about at least one rotational axis, the reels being individually indexable to present a set of symbols at selected angular positions about their respective axes for viewing purposes;

a window for directly viewing a first portion of the symbols at the selected angular position for at least one reel;

an ancillary display adjacent to the window for viewing a second portion of the symbols for said at least one reel, said second portion being an extension of the first portion and the second portion including symbols which are otherwise not directly viewable through the window;

wherein said at least one reel includes a separate window element and a separate ancillary display;

an ancillary display assembly comprising:

a mirror reflecting an image of the second portion of the symbols from said at least one reel; and a reversing lens through which the image from the mirror can be viewed by a player.

13. A slot machine, comprising:

a plurality of reels, each reel having symbols arranged in a series about a rotational axis, the reels being individually indexable to present a set of symbols at selected angular positions about their respective axes for viewing purposes;

at least one window for viewing selected portions of the plurality of reels;

at least one of the symbols being positioned at the selected angular position of at least one of said plurality of reels; and at least one mirror reflecting second portions of the symbols contained on at least one of the plurality of reels, said second portions being not directly viewable by a player viewing directly through the at least one window; and at least one display through which the mirror can be viewed by a player.

14. A slot machine, comprising:

a plurality of reels, said plurality of reels having symbols arranged upon the reels; the reels being capable of being individually indexed to present varying sets of selected symbols which determine play of the slot machine;

at least one display for viewing at least a portion of the symbols presented on the reels; said at least one display including at least one window through which a player can directly view one or more symbols which are upon at least one a first portion of the symbols positioned at selected angular positions of the plurality of reels;

at least one image collector for collecting images of the symbols from a second portion of at least one of the plurality of reels; said image collector being capable of collecting images from said second portion which are not directly viewable through said at least one window;

at least one image conveyor for conveying the image from the at least one image collector to provide display of an image upon the at least one display for viewing by a player.

15. The slot machine of claim 14, wherein the at least one image conveyor includes an array of optical fibers.

16. The slot machine of claim 14, wherein the at least one image collector includes at least one mirror.

17. The slot machine of claim 14, wherein the at least one image collector includes at least input ends of an array of optical fibers.

18. The slot machine of claim 14, wherein the plurality of reels comprise independently rotatable cylinders having visual symbols arranged about their respective circumferential peripheries.

19. A slot machine, comprising:

a plurality of reels, said plurality of reels having symbols arranged upon the reels; the reels being capable of being individually indexed to present varying sets of selected symbols which determine play of the slot machine;

at least one display for viewing at least a portion of the symbols arranged upon the plurality of reels; said at least one display including at least one window through which a player can directly view symbols contained in a first portion of the symbols which are directly viewable through the at least one window;

at least one optical system transmitting a representation of symbols from a second portion of at least one of the plurality of reels; said at least one optical system providing visual access to symbols contained in the second portion at the same time a player can view images of the first portion which are directly viewable through a window by a player of the slot machine.

20. The slot machine of claim 19, wherein the at least one optical system includes at least one mirror for reflecting at least one image of said second portion.

21. The slot machine of claim 19, wherein the at least one optical system includes at least one image collector.

22. The slot machine of claim 19, wherein the at least one optical system includes at least one image collector; said at least one image collector including input ends of an array of optical fibers.

23. The slot machine of claim 19, wherein the at least one optical system includes at least one image conveyor.

24. The slot machine of claim 19, wherein the at least one optical system includes at least one image conveyor having a plurality of optical fibers.

25. The slot machine of claim 19, wherein the plurality of reels comprise independently rotatable cylinders having visual symbols arranged about their respective circumferential peripheries.

* * * * *